United States Patent [19]

Doll et al.

[11] Patent Number: 4,508,683

[45] Date of Patent: Apr. 2, 1985

[54] CONTROL OF CYANIDES IN FCC REACTOR BY INJECTION OF AMMONIUM POLYSULFIDE

[76] Inventors: Brian E. Doll, 1020 Central Ave., Ocean City, N.J. 08226; Patrick G. Smyth, 726 Bayview Dr., Hermosa Beach, Calif. 90254

[21] Appl. No.: 550,515

[22] Filed: Nov. 10, 1983

Related U.S. Application Data

[63] Continuation of Ser. No. 357,955, Mar. 15, 1982, abandoned.

[51] Int. Cl.[3] ..... C23F 11/06

[52] U.S. Cl. ..... 422/7; 203/7; 208/47; 210/752; 210/757; 210/758; 210/765; 210/904; 422/13

[58] Field of Search ..... 203/7; 208/47; 210/719, 210/720, 721, 722, 757, 758, 763, 903, 904, 752, 749, 765; 422/7, 13, 14

[56] References Cited

FOREIGN PATENT DOCUMENTS 2307669 8/1974 Fed. Rep. of Germany ..... 210/904

OTHER PUBLICATIONS

French, "Water-soluble Inhibitors can Control Severe Corrosion Rates in FCC Units", The Oil and Gas Journal, Apr. 12, 1976.

Knowlton, "Source Control Pays Off for Chevron", The Oil and Gas Journal, Aug. 7, 1978.

Kunz, "Refinery Cyanides: A Regulatory Dilemma", Hydrocarbon Processing, Oct., 1978.

Ehmke, "Polysulfide Stops FCCU Corrosion", Hydrocarbon Processing, Jul., 1981.

*Primary Examiner*—Ernest G. Therkorn

[57] ABSTRACT

The concentration of cyanides in the sour water system of FCC reactor is controlled by injecting such an amount of ammonium polysulfide (APS) into the system that the weight ratio of net free sulfur to simple cyanides in the sour water is about 0.6 to about 3.8. The pH of the sour water is at least 8.0.

16 Claims, 8 Drawing Figures

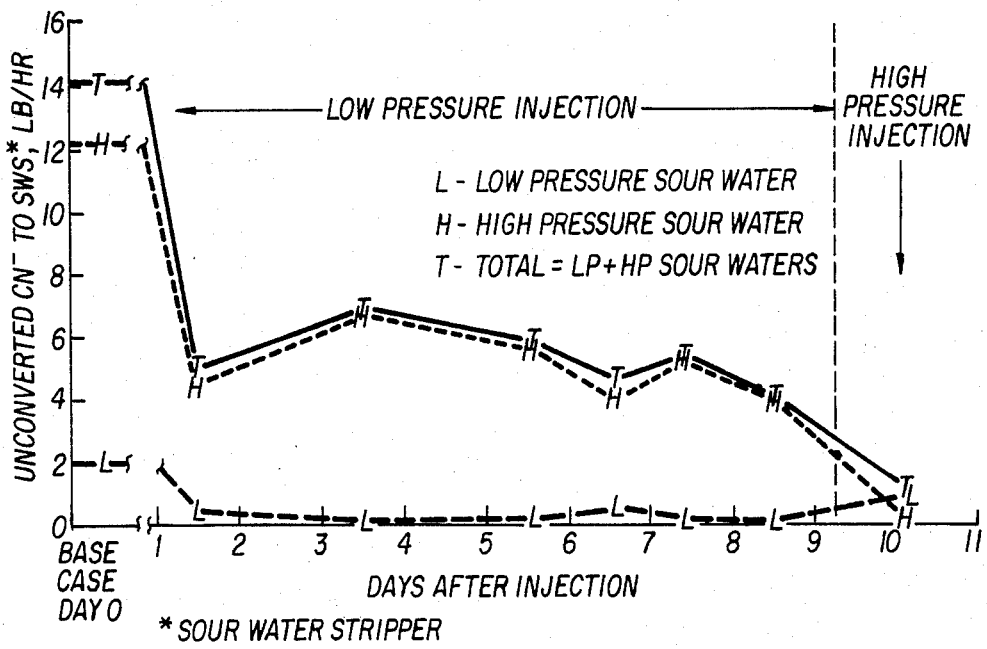
FIG. 2A CYANIDES IN SOUR WATERS TO SWS: AMOUNT OF UNCONVERTED CYANIDE
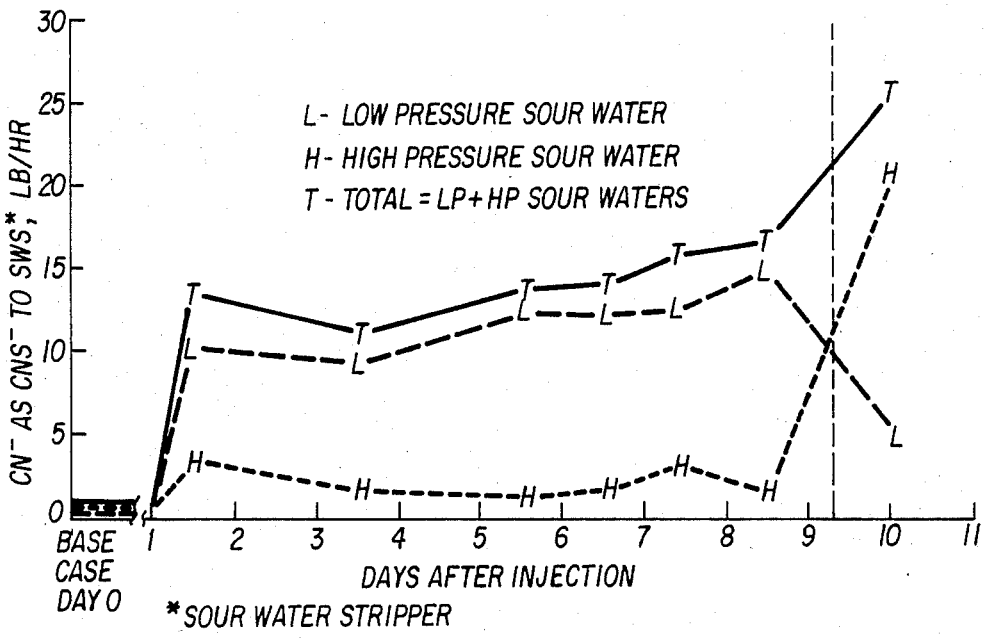
FIG. 2B CYANIDES IN SOUR WATERS TO SWS: AMOUNT OF CYANIDE CONVERTED TO THIOCYANATE

FCC TOTAL CYANIDE PRODUCTION

CN⁻ PRODUCTION, LB/HR
50
40
30
20
10
0
BASE CASE DAY 0
1
2
3
4
5
6
7
8
9
10
11
DAYS AFTER INJECTION

API GRAVITY OF FCC FRESH FEED

API GRAVITY
23.5
23
22.5
22
21.5
BASE CASE DAY 0
1
2
3
4
5
6
7
8
9
10
11
DAYS AFTER INJECTION

FCC FRESH FEED RATE

FEED RATE, MBPD
65
60
55
50
BASE CASE DAY 0
1
2
3
4
5
6
7
8
9
10
11
DAYS AFTER INJECTION

CONTROL OF CYANIDES IN FCC REACTOR BY INJECTION OF AMMONIUM POLYSULFIDE

This is a continuation of copending application Ser. No. 357,955, filed on Mar. 15, 1982, now abandoned.

BACKGROUND OF THE INVENTION

1. Field of the Invention

This invention relates to an improved method of controlling cyanides in the water system of an FCC reactor.

2. Description of the Prior Art

Refinery cyanides cause considerable corrosion, hydrogen blistering and waste water treatment problems. Majority of refinery cyanides are formed in the reactor of fluid catalytic cracking (FCC) units. In a typical refinery, a portion of the nitrogen from the crude enters in the feed to the catalytic cracker, wherein a large amount of the nitrogen is liberated as ammonia and a small amount as cyanide. All of the gas from the FCC reactor, including the ammonia and the cyanide, is carried overhead into the distillation column, where water is injected into the overhead stream for controlling corrosion problems. The resulting sour water is separated from the hydrocarbon products at various stages in the system, usually downstream of the FCC reactor. Most of the cyanides in the sour water become complexed with metal and are therefore known as complex cyanides. These complex cyanides are very difficult to remove from the water. With increased dependence of the refineries on sour crude containing progressively higher amounts of nitrogen, larger throughputs, and more severe processing conditions dictated by processing changes, corrosion and hydrogen blistering in sour water refinery overhead systems have recently increased dramatically.

In addition to cyanide-containing water from the FCC unit, significant concentrations of complex cyanides are also found in the waste water from coker units of the refinery. However, cyanides are produced in the coker units to a lesser extent than in the cracking units. This is due to the absence of a cracking catalyst, lower temperature and therefore lower severity of cracking. Coker effluent also contains a relatively large amount of water, originally added as steam in product strippers, coke drums and furnace coils. Accordingly, the concentration of cyanides in the water stream exiting the coker is relatively low.

In a typical refinery all of the cyanide-bearing streams are conducted to a sour water system wherein simple cyanides are stripped from the water in conventional stripping columns. However, complex cyanides (e.g., complexes of the cyanides with iron or other metals) are not readily strippable in such conventional stripping columns.

One of the previously known methods of controlling cyanide concentration in sour water streams involved injecting sulfur-containing compounds, i.e., polysulfides, such as sodium and ammonium polysulfides (APS), into the sour water system. The polysulfides convert the cyanide into non-corrosive, biodegradable thiocyanate before the complex non-strippable cyanide/metal complexes are formed. Thiocyanates are water soluble and they can be readily removed from the sour water by stripping. Prior art attempts of controlling cyanide content of sour water systems by the APS injection were often unsuccessful because it was found that a certain amount of cyanides could not be eliminated by injection and steam stripping. More particularly, the prior art relied heavily on steam stripping of the cyanides in conventional sour water strippers and on the treatment of the sour water stripper bottoms with sulphur. It was thought that some of the cyanides could be removed by steam stripping from the sour water system, and the remainder could be complexed with elemental sulphur which was used to contact sour water stripper bottoms. However, it was found that these attempts were largely unsuccessful because, it is believed, the cyanides in the sour water stripper bottoms were mostly complex cyanides. Complex cyanides, it is believed, are formed in the overhead portion of the FCC main fractionating column and in the unsaturated gas plant, usually located downstream of the FCC main fractionating column. Complex cyanides cannot be readily removed in steam strippers. Accordingly, some refineries experienced considerable problems with polysulfide injection into FCC units. Such problems involve, e.g., severe fouling and plugging of the sour water strippers (e.g., see Kunz et al, "Refinery Cyanides-A Regulatory Dilemma", *Hydrocarbon Processing,* October 1978, pages 98–106).

SUMMARY OF THE INVENTION

In accordance with the present invention, it has been discovered that the concentration of cyanides in the FCC sour water system can be effectively controlled by injecting the ammonium polysulfide solution into the system if the amount of the ammonium polysulfide (APS) solution injected is such that the weight ratio of net free sulfur to simple cyanides in the sour water is about 0.6 to about 3.8. It is also preferred to maintain the pH of the sour water at at least 8, and preferably in the range of about 9 to about 10. The injection of the APS under these conditions decreases or substantially eliminates the fouling and plugging problems experienced in the prior art with this method of cyanide control.

BRIEF DESCRIPTION OF THE DRAWINGS

FIG. 2A is a graphical representation of the amount of unconverted cyanides in the Example.

FIG. 2B is a graphical representation of the amount of cyanide converted to thiocyanate in the Example.

DETAILED DESCRIPTION OF THE INVENTION

Figure 1:
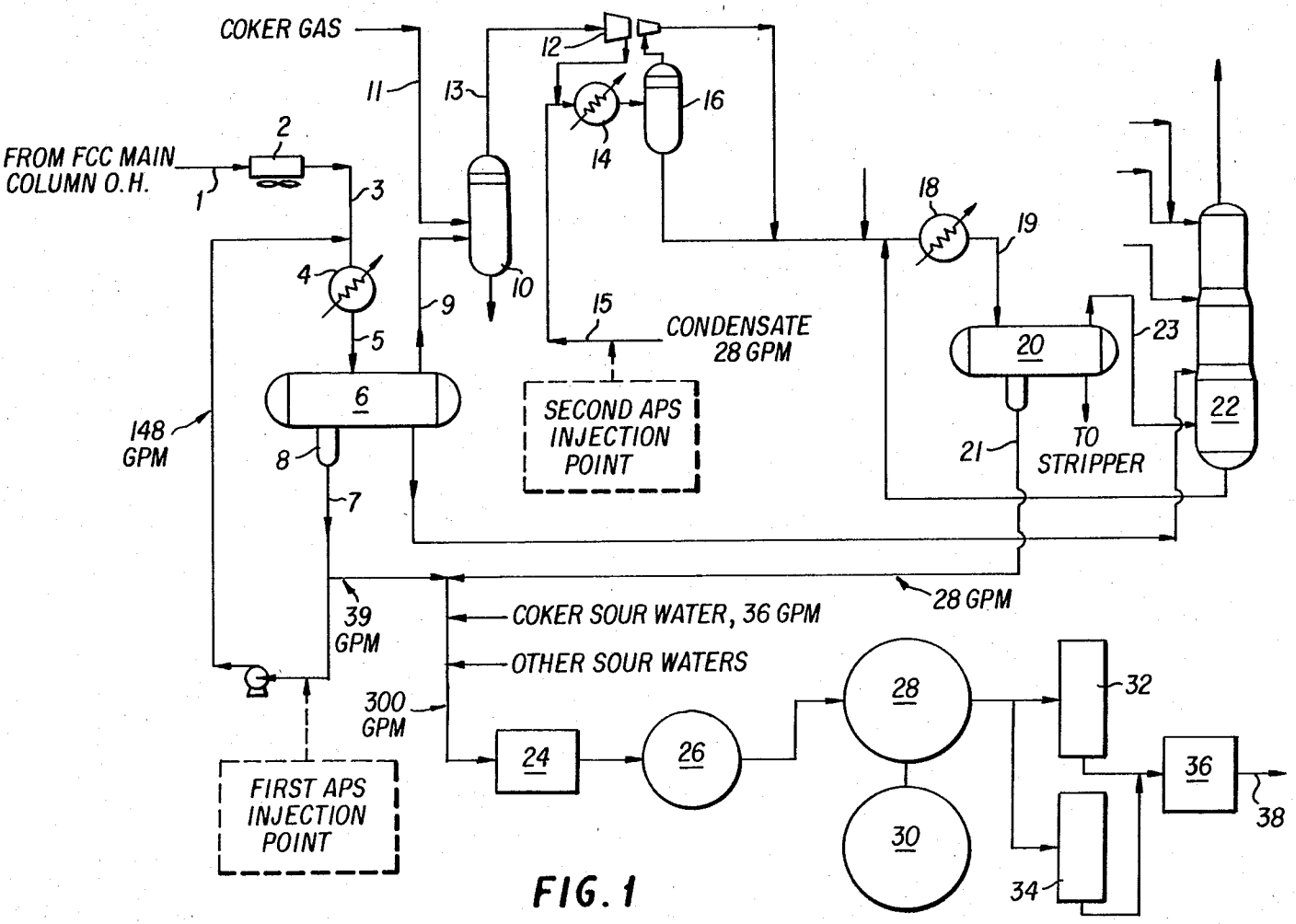
FIG. 1 is a schematic representation of the experimental apparatus used in the Example.

Ammonium polysulfide solution used in accordance with this invention is an aqueous ammonium sulfide solution (usually available in concentrations of up to 70 percent by weight), containing net free sulfur available for complexing weight simple cyanides. The net free sulfur is the sulfur which disassociates from the ammonia complex and reacts with cyanides to form the desired thiocyanates. Accordingly, in this specification and appended claims, all concentration ratios and ranges referring to the amount of sulfur are based on a net free sulfur weight basis in the APS solution.

Ammonium polysulfide solution is injected into the FCC plant at the point where sour water first condenses. Accordingly, the cyanides in the sour water are converted at this point to thiocyanates, thereby preventing the formation of complex iron and other metal cyanides. The reaction, it is believed, takes place in accordance with the following equation:

$$(NH_4)_2S_x + CN^- \rightarrow (NH_4)_2S_{x-1} + CNS^-$$

wherein x is an integer of 1 to 5. The APS solution is injected, for example, into an FCC main fractionating column overhead accumulator water circuit. The APS solution may also be injected independently into any other point in the sour water system wherein simple cyanides are contained, e.g., into an unsaturated gas plant. Alternatively, a portion of the water containing the APS solution injected upstream may be diverted and circulated downstream of the first injection point. In any event, the APS solution is injected into the sour water system at a point wherein the concentration of cyanides complexed with metals is less than 125 parts per million (ppm), preferably less than 97 ppm, and most preferably less than 87 ppm. At the point of the APS solution injection, the weight ratio of the simple uncomplexed cyanides to complex cyanides is at least 15, preferably at least 40, and most preferably at least 60. In this connection, the term "simple uncomplexed cyanides" or "simple cyanides" is used to designate cyanides formed by the disassociation of hydrocyanic acid (HCN) to cyanide ions ($CN^-$). The term "complex cyanides" is used herein to designate any complexes of cyanides with metals, such as iron, for example, ammonium ferrocyanide trihydrate or $[(NH_4)_4Fe(CN_6).(3\text{-}H_2O)]$, ferrous cyanide or $Fe_4[Fe(CN)_6]_3$ and ferric cyanide or $Fe_3[Fe(CN)_6]_2$. The injection of the APS at this point assures that a large proportion of the simple uncomplexed cyanides is converted to thiocyanates, thereby substantially preventing the formation of unreactive complex cyanides which are not easily removed from water and which cause environmental problems. The injection is maintained at such a rate that the pH of the water system is at least 8, and preferably 9–10. The maintenance of the pH at this level substantially prevents plugging of sour water strippers experienced in the prior art systems. The rate of injection is also maintained at such a level that the weight ratio of the free sulfur to the uncomplexed simple cyanides in the sour water is about 0.6 to about 3.8, preferably about 1.3 to about 3.1, and most preferably about 1.9 to about 2.5 when 35% net free sulfur by weight APS solution is used.

It will be understood by those skilled in the art that the process of this invention may be used in conjunction with any FCC installation wherein the control of cyanides may be troublesome. Accordingly, the following example, illustrating one application of the process of this invention, is not to be considered as a limitation on the scope of the disclosure or claims of this application.

EXAMPLE

FIG. 1 is a schematic representation of an FCC overhead system, a portion of unsaturated gas plant, and sour water treatment system, which were used in this example. Vapor 1 from the FCC main fractionation column overhead is composed of mostly gasoline and lighter hydrocarbons with traces of steam, hydrogen sulfide, ammonia and cyanide at about 300° F. The vapor stream 1 is cooled and partially condensed in the fin fans 2 (outlet temperature 150° F.) and in the trim cooler 4 (outlet temperature about 100° F.). The vapor, gasoline and sour water are then separated in the overhead accumulator 6. Between the inlet to the fin fans 2, and the accumulator 6, the pressure drops from 14 psig to 10 psig. The flow rate of stream 1 is about 39 gallons per minute of sour water. In this particular installation, 148 gallons per minute (gpm) (stream 7) of this low pressure sour water is continuously recycled from the accumulator boot 8 to the overhead line between the fin fans and the trim cooler.

The overhead accumulator sour water, before sulfide injection is started (base case), contains 98 parts per million (ppm) cyanide ions ($CN^-$) and 23 ppm $CN^-$ in the form of $CNS^-$. The presence of $CNS^-$ in the base case indicates that a small amount of oxygen in the system converted some sulfide to polysulfide which reacted with the cyanide. The amount of cyanide in the vapor leaving the overhead accumulator 6 is about 45 pounds per hour of $CN^-$ as HCN. The FCC total cyanide production, calculated from a cyanide balance around the overhead accumulator, amounts to about 47 pounds per hour (lb/hr) of $CN^-$. Only about 5% of this total is taken out in this low pressure accumulator sour water.

The wet gas from the accumulator 6 enters a low pressure knock-out drum 10, and is joined by a low pressure coker gas stream 11, which contributes about 1 lb/hr of $CN^-$ as HCN in the base case. The wet gas from the drum, stream 13, at 10 psig is compressed in a two stage compressor 12, which produces an interstage pressure of about 60 psig and a discharge pressure of about 210 psig. The compression of the vapor condenses out more hydrocarbons and sour water. Additionally, 28 gpm of condensate is added to the interstage trim cooler 14 through a conduit 15 to dilute the cyanides and wash more cyanides from the gas.

The steam condensate, added to the cooler 14, eventually comes out of the gas plant in the high pressure receiver 20, which separates the high pressure gas, gasoline and sour water. This sour water, stream 21, contains in the base case 870 ppm $CN^-$ and 39 ppm of $CN^-$ as CNS which results in about 12 lb/hr $CN^-$ and 0.5 lb/hr $CN^-$ as $CNS^-$.

Of the about 45 lb/hr $CN^-$ entering the high pressure receiver 20 as the vapor stream 19, about 13 lb/hr left in the sour water (stream 21) and about 32 lb/hr, or 72% of cyanide, passes through the vapor line 23 leaving the high pressure receiver. Of the about 47 lb/hr of cyanide from the FCC and about 1.0 lb/hr from the coker, 15.0 lb/hr or about 31%, goes out in the sour water and 69% goes into the gas plant. The high pressure coker gas going to the absorber 22 contributes about 2.0 lb/hr $CN^-$ as HCN.

The low pressure and high pressure (i.e., the latter being introduced through a conduit 15) sour waters contribute a total of about 14 lb/hr $CN^-$ and 1.0 lb/hr $CN^-$ as $CNS^-$ to the sour water system. The coker sour waters contain about 33 ppm $CN^-$ as $CNS^-$. At an estimated flow rate of 36 gallons per minute (gpm), this results in a contribution of about 0.60 lb/hr $CN^-$ as $CNS^-$ to the sour water system. The cokers contribute only about 1% of the total $CN^-$ to the sour water system. They contribute 6% of the $CN^-$ as HCN to the vapor downstream of the FCC overhead accumulator.

The sour waters from all of the refinery units are combined and deoiled in a Primary Waste Water Recovery Unit or API separator 24. The deoiled sour water goes through a series of tanks 26, 28, 30 and then to sour water strippers 32, 34 to remove $H_2S$, ammonia and some of the simple cyanides. The sour water stripper bottoms then goes to a foul water oxidizer 36 where any sulfides, complexed as salts, are oxidized to thiosulfate ($S_2O_3^=$). The foul water oxidizer effluent then goes to a final holding tank which is tested for thiosulfate daily and discharged to the wastewater going to the municipal treatment plant.

Samples of sour water stripper feed and bottoms taken before the start of APS injection showed about 20 ppm of total cyanide in the feed and about 10 ppm in the bottoms.

DESCRIPTION OF THE INJECTION PERIOD

The equipment used to inject polysulfide comprised a conventional injection pump—a Hills-McCanna McCannamite II positive displacement diaphragm pump with pneumatic stroke control. FCC light cycle oil was used to initially test the system and establish flow rates. The ammonium polysulfide used in the test had the properties set forth in Table A, below.

TABLE A

| Properties of Ammonium Polysulfide Used in the Test | |
|---|---|
| Free Sulfur Content | 35.4% |
| Specific Gravity @ 60° F. | 1.16 |
| pH | 11 |
| Viscosity @ 60° F., Centipoise | 6 |

Supplier: Los Angeles Chemical Co. Southgate, California

The polysulfide was always covered with a 6" layer of Light Cycle Oil (LCO), having an API gravity of 20 to inhibit air oxidation and ammonia evaporation. Polysulfide injection was started on day 1 at a rate of 6 gph. The rate was varied over the next 7 days to determine the optimum injection rate. During the sixth and seventh days, the recycle rate of the low pressure sour water (stream 7) was decreased from 148 to 75 gpm to evaluate the effect of recycle ratio on the APS reaction.

Throughout the low pressure APS injection, a substantial reduction in the cyanides in the accumulator sour water was observed. However, much of the cyanide was still going to the gas plant.

At that point, the APS injection was started into the 28 gpm condensate stream 15 to the interstage cooler. The low pressure injection into stream 7 was stopped at that time. Only a 2 hour injection run was made into the high pressure condensate stream 15. The initial injection rate was 14 gph. However, the high pressure sour water did not exhibit the pale yellow color indicative of excess APS after the first 80 minutes of injection. The injection rate was then increased to 22 gph for the next 30 minutes, at which time the samples were drawn. The high pressure sour water did exhibit the yellow color at that time.

RESULTS AND DISCUSSION

APS Injection

The base case showed about 2.0 lb/hr $CN^-$ and about 12 lb/hr $CN^-$ in the low and high pressure sour waters, respectively. During the best low pressure APS injection these quantities were reduced to 0.1 lb/hr $CN^-$ and about 4.0 lb/hr $CN^-$ in the low and high pressure sour waters, respectively. During the high pressure injection only 0.1 lb/hr $CN^-$ went out in the high pressure sour water. These results are summarized in Table 1. In terms of concentration, the low pressure sour water total cyanides were reduced from 98 ppm to 6 ppm during the best low pressure injection period and the high pressure sour water cyanides were reduced from 870 ppm to 9 ppm during the high pressure injection. If these results could be achieved by simultaneous injection of APS into the low and high pressure systems, a 98% reduction in the cyanides of the sour waters would be achieved. FIG. 2B shows the amount of cyanide that was converted to thiocyanate in the low and high pressure sour waters.

A typical refinery's corrosion/hydrogen blistering problems result from the cyanides in the gas entering the gas plant. Therefore, it is preferred to have as much cyanide as possible go into sour water, either as cyanide or thiocyanate. The best low pressure injection resulted in 15.1 lb/hr $CN^- + CN^-$ as $CNS^-$ in the low pressure sour water. The high pressure injection resulted in about 21 lb/hr $CN^- + CN^-$ as $CNS^-$ leaving the system in the high pressure sour water.

Figure 3A:
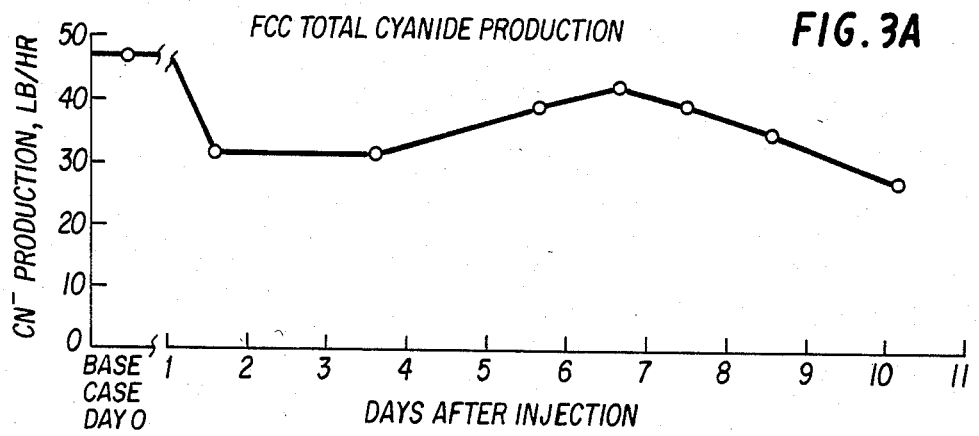
FIG. 3A is a graphical representation of the total amount of cyanides produced by the FCC unit in the Example.
Figure 3B:
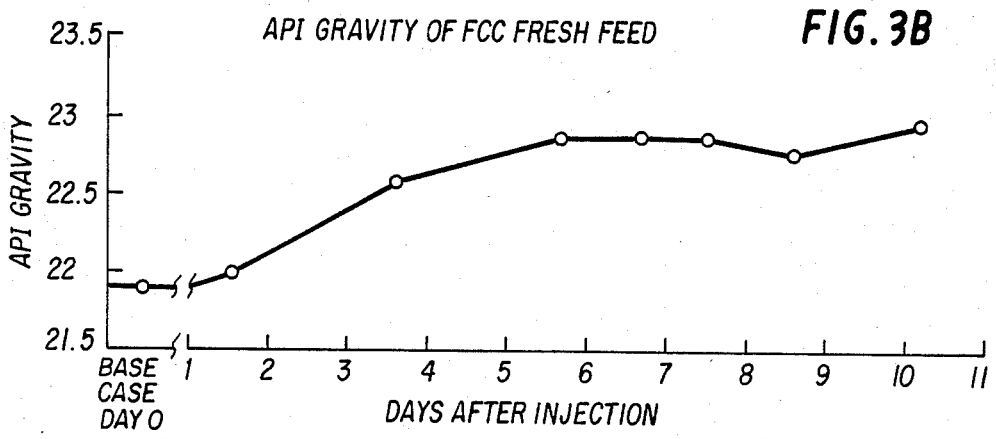
FIG. 3B is a graphical representation of API gravity of FCC fresh feed in the Example.
Figure 3C:
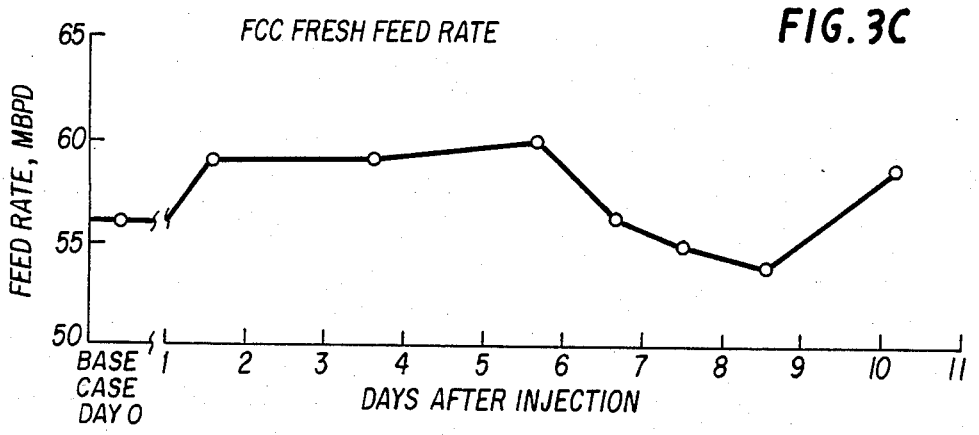
FIG. 3C is a graphical representation of the fresh feed rate, as a function of the day of the experiment in the Example.
Figure 4:
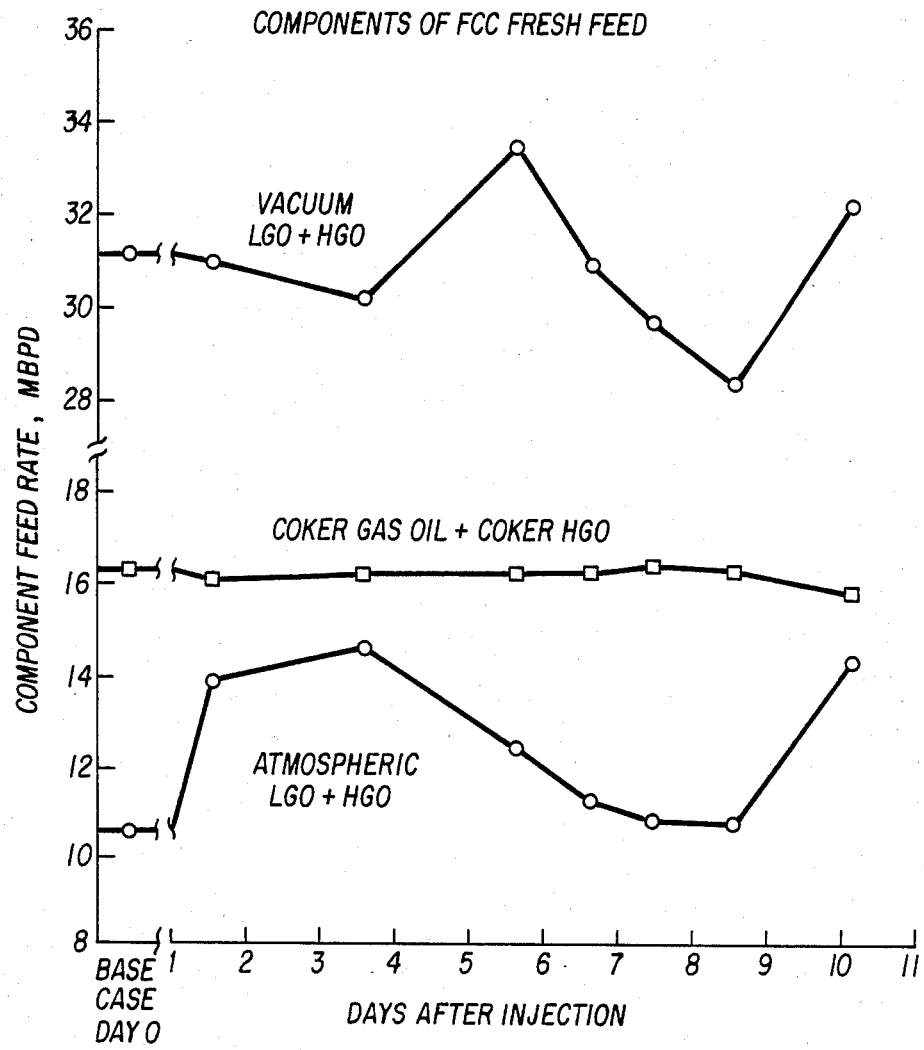
FIG. 4 is a graphical representation of the FCC fresh feed content used in the Example.

The total amount of cyanides produced by the FCC unit during this test is graphically shown in FIG. 3A. As shown in that Figure, the cyanide production rate fluctuated throughout the test from 47.5 lb/hr during the base case to 27.5 lb/hr during the high pressure injection. This fluctuation was due primarily to the change of the nitrogen content in the feed rather than to the FCC operating conditions. Samples of FCC fresh feed were analyzed on the day before the injection was begun and on the seventh day after it had begun. These analyses are given in Table 2. The total nitrogen in the feed on these two days was 0.33 wt % and 0.24 wt %, respectively. This large fluctuation is associated with an increase in the API gravity of the feed as shown in FIG. 3B. The fresh feed rate is shown in FIG. 3C. The components that make up this fresh feed from the atmospheric tower, vacuum tower and coker are shown in FIG. 4, which further demonstrates the changes in FCC feed composition. The FCC operating conditions were fairly stable throughout the test.

Base Case Observations

The base case studies performed before the injection of APS showed that the 39 gpm of sour water from the accumulator 6 at 10 psig contained 98 ppm total $CN^-$ and the 28 gpm of sour water from the receiver 20 at 210 psig contained 870 ppm total $CN^-$. Since the cyanide concentration in the aqueous phase is the vital component of the hydrogen blistering mechanism discussed earlier, it is not surprising that the greatest corrosion/hydrogen blistering problems occur in high pressure lines and vessels. It is possible, therefore, that the concentrations of cyanide in the vapor and water phases approach a pressure dependent equilibrium throughout the FCC/unsaturated gas plant system.

Evaluation of Change in Recycle Rate on APS Efficiency

As discussed in the previous Base Case Observations Section, the recycle of 148 gpm of low pressure condensate probably does little to remove additional cyanide from the vapor phase during the normal operation. In order to determine the effect of the recycle rate on the APS reaction, the recycle rate was cut in half for two days. Table 3 compares these two days to days with the same APS injection rate and full recycle rate. As shown in this table, the percent of FCC cyanides converted to thiocyanates is almost the same, 30%, for all 4 days even when an excess in polysulfide was observed on the 8 gph injection rate days. When the injection rate was raised to 10 gph, conversion increased to 43%. The recycle rate appears to have little effect on the conversion. Only a large excess of polysulfide can increase the conversion in the low pressure system.

The results of the test are summarized in Table 4, below, which demonstrates that ammonium polysulfide can successfully reduce the amount of cyanide leaving the high pressure receiver to the gas plant in the vapor line by over 90%.

TABLE 3

Effect of Sour Water Recycle Rate on Low Pressure APS Injection

| | ½ Recycle to Overhead Line | | Full Recycle to Overhead Line | | |
|---|---|---|---|---|---|
| APS Injection Rate, gph | 6 | 8 | 6 | 8 | 10 |
| Sour Water Recycle Rate, gpm | 75 | 75 | 148 | 148 | 148 |
| Percent of FCC Cyanide Converted to $CNS^-$ in Ovhd. Accum. Sour Water | 29 | 32 | 32 | 29 | 43 |
| Total $CN^-$ in Ovhd. Accum. Sour Water, ppm | 27 | 8 | 11 | 7 | 6 |
| Total $CN^-$ in Ovhd Accum. Sour Water, Lb/Hr | 0.5 | 0.1 | 0.2 | 0.1 | 0.1 |
| $CN^-$ as $CNS^-$ in Ovhd. Accum. Sour Water, Lb/Hr | 12.3 | 12.6 | 12.5 | 9.3 | 15.0 |
| Total $CN^-$ Produced by | 42.3 | 39.2 | 39.1 | 31.6 | 35.0 |

TABLE 1

SUMMARY OF RESULTS

| | Base Case Before Injection (Day 0) | Low Pressure Injection (Day 9) | High Pressure Injection (Day 11) |
|---|---|---|---|
| APS Rate, gph | 0 | 10 | 14–22 |
| $CN^-$ from FCC + Coker, Lb/Hr | 47.9 | 35.9 | 28.4 |
| $CN^-$ in Low Pressure Sour Water, Lb/Hr | 1.9 | 0.1 | 1.0 |
| $CN^-$ as $CNS^-$ in Low Pressure Sour Water, Lb/Hr | 0.4 | 15.0 | 4.8 |
| $CN^-$ $CN^-$ as $CNS^-$ in Low Pressure Sour Water, Lb/Hr | 2.3 | 15.1 | 5.8 |
| $CN^-$ in High Pressure Sour Water, Lb/Hr | 12.2 | 3.9 | 0.1 |
| $CN^-$ as $CNS^-$ in High Pressure (HP) Sour Water, Lb/Hr | 0.5 | 1.8 | 21.0 |
| $CN^-$ + $CN^-$ as $CNS^-$ in High Pressure Sour Water, Lb/Hr | 12.7 | 5.7 | 21.1 |
| $CN^-$ to Gas Plant, Lb/Hr | 32.9 | 15.1 | 1.5 |

TABLE 2

Test of APS Injection in FCC/Unsat Gas Plant

Fresh Feed Properties

| | FCC Fresh Feed Before APS Injection | | | FCC Fresh Feed On Day 7 of the Injection | | |
|---|---|---|---|---|---|---|
| TBP Fraction | IBP to 650° F. | 650° F.+ | Total | IBP to 650° F. | 650° F.+ | Total |
| Yield, % wt | 40.0 | 60.0 | 100.0 | 40.8 | 59.2 | 100.0 |
| Nitrogen Content | | | | | | |
| Total Nitrogen, wt % | | | 0.33 | | | 0.24 |
| Basic Nitrogen, ppm | 1155 | 1514 | 1405 | 920 | 1625 | 1180 |
| Other Physical Properties | | | | | | |
| Gravity, °API | | | 22.2 | | | 22.7 |
| Aniline Point, °F. | | | 129.8 | | | 131.1 |
| Sulfur, % wt | 1.19 | 1.35 | 1.30 | 1.03 | 1.21 | 1.18 |
| Bromine Number | | | 13.4 | | | 11.8 |
| Hydrogen Content, % wt | | | 10.5 | | | 11.7 |
| Molecular Weight | 220 | 354 | 285 | 219 | 335 | 273 |
| R.I. @ 70° C. | 1.4729 | 1.5070 | 1.4934 | 1.4675 | 1.5049 | 1.4894 |
| Derisity @ 70° C. | 0.8501 | 0.9098 | 0.8847 | 0.8438 | 0.9082 | 0.8810 |
| Specific Gravity @ 60° F. | 0.8872 | 0.9470 | | 0.8823 | 0.9499 | |
| Composition, wt % | | | | | | |
| Paraffins | 15.3 | 11.2 | | | | |
| Napthenes | 39.4 | 32.4 | | | | |
| Total Aromatics | 45.3 | 56.4 | | | | |
| $C_A$ | 20.4 | 23.4 | | | | |

| FCC, Lb/Hr | | | | | |
|---|---|---|---|---|---|
| Day of Test | 6 | 7 | 5 | 3 | 8 |

TABLE 4

Cyanide/Thiocyanate Data during APS Injection Test

| Day of | Total FCC $CN^-$ Entering Main Column Ovhd. Accum. (calculated) | Total $CN^-$ in Main Column Ovhd. Accum. (6) Sour Water | $CN^-$ as $CNS^-$ in Main Column Low Pressure Ovhd. (6) Accum. Sour Water | $CN^-$ as HCN in Low Pressure FCC Wet Gas to Drum 10 |
|---|---|---|---|---|

TABLE 4-continued

| Cyanide/Thiocyanate Data during APS Injection Test | | | | | | |
|---|---|---|---|---|---|---|
| Test | | lb/hr | ppm (wt) | lb/hr | lb/hr | lb/hr |
| 0 | Base Case | 47.9 | 98 | 1.9 | 0.4 | 44.6 |
| | Low Pressure Injection | | | | | |
| 1 | 2 hrs after start of test. APS Rate - 6 gph Full Recycle | 31.8 | 19 | 0.4 | 10.1 | 21.3 |
| 3 | APS Rate - 8 gph Full Recycle | 31.6 | 7 | 0.1 | 9.3 | 22.2 |
| 5 | APS Rate - 6 gph Full Recycle | 39.1 | 11 | 0.2 | 12.5 | 26.4 |
| 6 | APS Rate - 6 gph ½ Recycle | 42.3 | 27 | 0.5 | 12.3 | 29.5 |
| 7 | APS Rate - 8 gph ½ Recycle | 39.2 | 8 | 0.1 | 12.6 | 26.5 |
| 8 | APS Rate - 10 gph Full Recycle | 35.9 | 6 | 0.1 | 15.0 | 19.9 |
| | High Pressure Injection | | | | | |
| 10 | APS Rate, 14–22 gph | 28.4 | 49 | 1.0 | 4.8 | 21.6 |

| Day of Test | | $CN^-$ as HCN in Low Pressure Coker Gas to Drum 10 | Total $CN^-$ in High Pressure Receiver (20) Sour Water | | $CN^-$ as $CN^-$ in High Pressure Receiver (20) Sour Water | $CN^-$ as HCN in Gas from High Pressure Receiver (20) Entering Gas Plant (Calculated) |
|---|---|---|---|---|---|---|
| | | lb/hr | ppm (wt) | lb/hr | lb/hr | lb/hr |
| 0 | Base Case | 0.9 | 870 | 12.2 | 0.5 | 32.8 |
| | Low Pressure Injection | | | | | |
| 1 | 2 hrs after start of test. APS Rate - 6 gph Full Recycle | 31.8 | 19 | 0.4 | 10.1 | 21.3 |
| 3 | APS Rate - 8 gph Full Recycle | 0.6 | 480 | 6.7 | 1.8 | 14.3 |
| 5 | APS Rate - 6 gph Full Recycle | 0.6 | 398 | 5.6 | 1.4 | 20.0 |
| 6 | APS Rate - 6 gph ½ Recycle | 0.6 | 290 | 4.1 | 1.9 | 24.1 |
| 7 | APS Rate - 8 gph ½ Recycle | 0.9 | 371 | 5.2 | 3.3 | 18.9 |
| 8 | APS Rate - 10 gph Full Recycle | 0.9 | 276 | 3.9 | 1.8 | 15.1 |
| | High Pressure Injection | | | | | |
| 10 | APS Rate, 14–22 gph | 1.0 | 9 | 0.1 | 21.0 | 1.5 |

Figure 5:
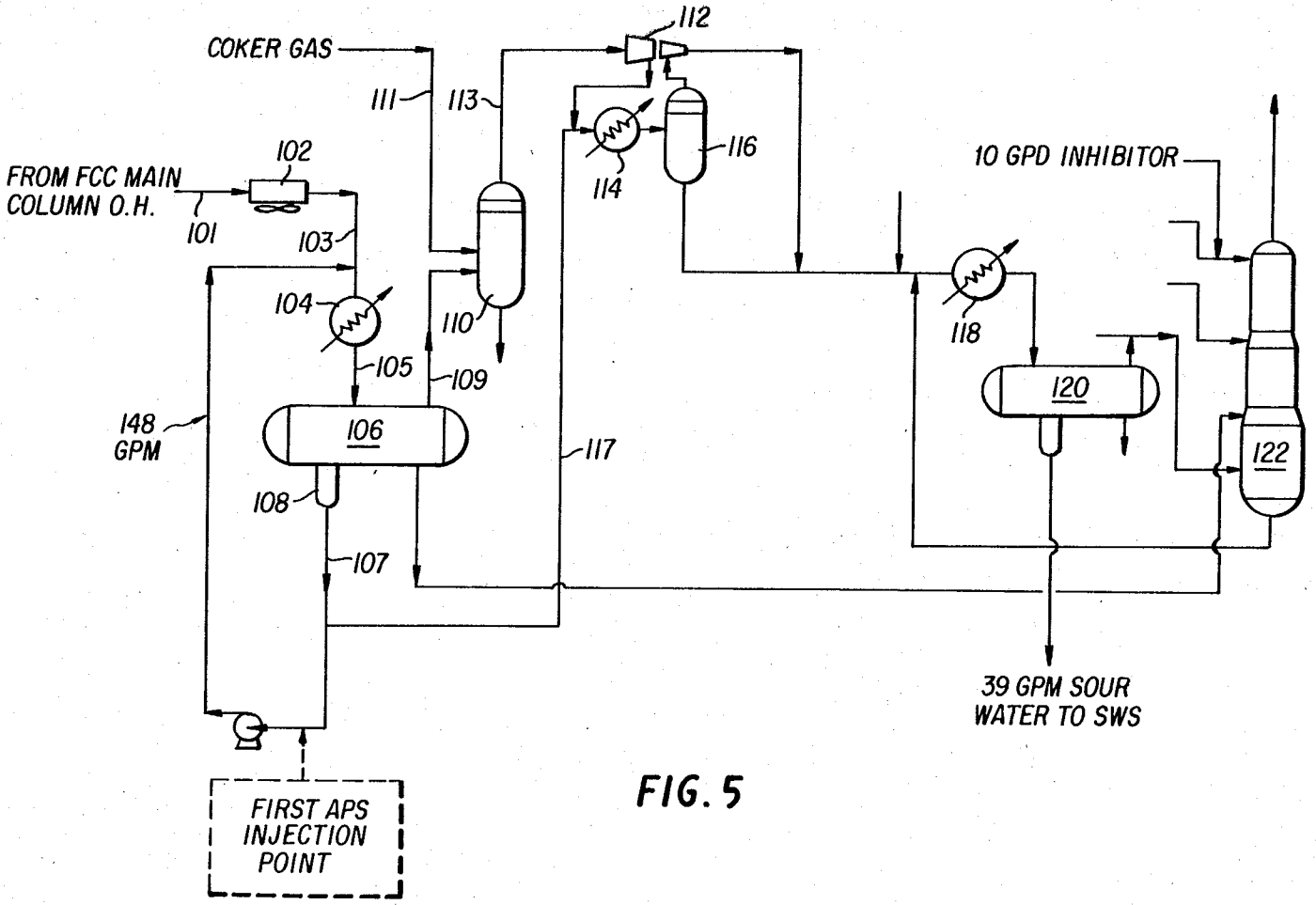
FIG. 5 is a schematic representation of an alternative embodiment of the experimental apparatus of the Example.

The decrease is achieved with a relatively low rate of injection of APS and without noticeable plugging of the downstream equipment. The successful utilization of the APS injection method to control cyanides appears to be dependent on the maintenance of a sufficiently high concentration of APS in the sour water system. Such high concentration may also be maintained by rearranging the sour water system to the more economical arrangement shown in FIG. 5. In this arrangement, the APS would be injected only into the low pressure sour water recycle line 107 as shown in FIG. 5. The overhead accumulator sour water would then be reinjected, via conduit 117, into the interstage cooler instead of the high pressure condensate. This mode of operation would require a much larger APS concentration in the low pressure system which would increase the efficiency of cyanide removed from the vapor phase in the overhead line.

Assuming the same process conditions as in the process of FIG. 1, the reuse of the overhead accumulator sour water would reduce the total amount of sour water going to the sour water stripper (SWS) by 28 gpm, which would result in a considerable saving of stripping steam. With proper use of APS injection, complexes of cyanides with metals would not form. The ammonium thiocyanate salts which may form are extremely water soluble and would dissolve in the overhead accumulator sour water. This system would also use much less APS or other sulfides, since the amount of sour water containing excess APS leaving the unit would be reduced. Additionally, the higher pressure, which the sour water would be exposed to at the end of its flow path through the system, would favor a more complete reaction with the cyanide and would necessitate a much lower APS residual.

In the embodiment of FIG. 5 all unit operations and process streams operate in the manner indicated above in connection with the discussion of the embodiment of FIG. 1. All such unit operations and process streams are numbered in a manner identical to those of FIG. 1, but they are preceded by a prefix 100, e.g., streams 1 and 3 of FIG. 1 correspond to streams 101 and 103, respectively, of FIG. 5. Accordingly, it is believed, the operation of the embodiment of FIG. 5 would be obvious to those skilled in the art from the above description of the embodiment of FIG. 1.

It will be apparent to those skilled in the art that the above example can be successfully repeated with ingredients equivalent to those generically or specifically set forth above and under variable process conditions.

From the foregoing specification one skilled in the art can readily ascertain the essential features of this invention and without departing from the spirit and scope thereof can adopt it to various diverse applications.

What is claimed is:

1. In a method of controlling the concentration of cyanides in the sour water system of a fluid catalytic cracking (FCC) reactor comprising injecting a solution of ammonium polysulfide (APS) into the water system of the reactor, the improvement wherein the solution of ammonium polysulfide is injected at the point in the sour water system wherein the concentration of cyanides complexed with metals is less than 125 ppm, thereby promoting the conversion of a large proportion of simple cyanides to thiocyanates and substantially preventing the formation of complex cyanides in excess of the amount thereof present at the point of injection.

2. A method of claim 1 wherein the concentration of cyanides complexed with metals is less than 97 ppm.

3. A method of claims 1 or 2 wherein the cyanides complexed with metals are iron cyanide complexes.

4. A method of claim 2 wherein at the point of injection of the ammonium polysulfide, the weight ratio of simple to complex cyanides is at least 15.

5. A method according to claim 4 wherein the weight ratio of simple to complex cyanides is at least 40.

6. A method according to claim 5 wherein the concentration of simple to complex cyanides is at least 60.

7. A method according to claims 1, 2 or 3 wherein the sour water has a pH of at least 8.

8. A method according to claim 7 wherein the sour water has a pH of at least 9.

9. A method according to claim 8 wherein the solution of ammonium polysulfide contains 35% net free sulfur by weight and the rate of injection thereof is such that the weight ratio of free sulfur to simple cyanides in the sour water is about 0.6 to about 3.8.

10. A method according to claim 9 wherein the weight ratio of free sulfur in the ammonium polysulfide to simple cyanides in the sour water is about 1.3 to about 3.1.

11. A method according to claim 10 wherein the weight ratio of free sulfur in the ammonium polysulfide to simple cyanides in the sour water is about 1.9 to about 2.5.

12. A method according to claim 7 wherein the sour water has a pH of about 9 to about 10.

13. A method according to claim 1 wherein the concentration of cyanides complexed with metals is less than 87 ppm.

14. A method according to claim 7 wherein the solution of ammonium polysulfide is injected into the main FCC fractionation column overhead effluent.

15. A method according to claim 14 wherein the solution of ammonium polysulfide is also injected into a water stream, downstream from the main FCC fractionation column overhead effluent, said water stream operating at a relatively higher pressure than the main FCC fractionation column overhead effluent.

16. A method according to claim 14 wherein at least a portion of the water containing the ammonium polysulfide is conducted from the overhead water system to a downstream water system operating at a relatively higher pressure than the overhead water system.

* * * * *